United States Patent [19]

Takahashi

[11] Patent Number: 5,045,761

[45] Date of Patent: Sep. 3, 1991

[54] METHOD OF GATING ELECTRON TUBE AND THE ELECTRON TUBE OPERATED BY SAID METHOD

[75] Inventor: Akira Takahashi, Shizuoka, Japan

[73] Assignee: Hamamatsu Photonics K. K., Shizuoka, Japan

[21] Appl. No.: 550,982

[22] Filed: Jul. 11, 1990

[30] Foreign Application Priority Data

Aug. 4, 1989 [JP] Japan ..... 1-202584

[51] Int. Cl.[5] ..... H01J 29/74

[52] U.S. Cl. ..... 315/410; 250/213 VT

[58] Field of Search ..... 315/410; 250/213 VT; 313/529

[56] References Cited

U.S. PATENT DOCUMENTS

| | | | |
|---|---|---|---|
| 4,801,796 | 1/1989 | Kinoshita et al. | 250/213 VT |
| 4,948,952 | 8/1990 | Guyot | 250/213 VT |
| 4,956,548 | 9/1990 | Alfano et al. | 250/213 VT |

FOREIGN PATENT DOCUMENTS 2211983 7/1989 United Kingdom .

OTHER PUBLICATIONS

Development and Evaluation of a New Femtosecond Streak Camera by Finch et al.

*Primary Examiner*—Theodore M. Blum

*Attorney, Agent, or Firm*—Finnegan, Henderson, Farabow, Garrett and Dunner

[57] ABSTRACT

An electron tube, such as a streak tube, is equipped with a gate element for gating unnecessary photoelectrons to prevent them from appearing as a pseudo output signal. A deflection voltage of main deflection plates (typically travelling-wave type) is delayed by a predetermined time and provided to the gate element. The gate element may be shifting deflection plates for sweeping the photoelectrons in a direction perpendicular to the main sweeping direction, a microchannel plate for multiplying the photoelectrons, or a photocathode.

16 Claims, 6 Drawing Sheets

METHOD OF GATING ELECTRON TUBE AND THE ELECTRON TUBE OPERATED BY SAID METHOD

BACKGROUND OF THE INVENTION

This invention relates to a method of gating an electron tube in such a way that a pseudo signal will not appear on its phosphor screen during retracing which follows the main sweeping of photoelectrons emitted from its photocathode. The invention also relates to an electron tube, such as a streak tube in a streak camera, that is operated by said method.

A typical configuration of the streak tube is shown in FIG. 9 and it comprises a photocathode 2 on which the incident light from an input optical system 1 is imaged, deflection plates 3 with which the photoelectrons emitted from the photocathode 2 upon photoelectric conversion are deflected by an applied sweep voltage, a phosphor screen 4 on which the time-dependent change in intensity of the incident light is obtained as the change in brightness with respect to the position of the screen 4, and a microchannel plate (hereinafter abbreviated as "MCP") which is positioned in front of the phosphor screen 4 for multiplying the photoelectrons before their incidence on the screen 4. Shown by numerals 6 and 7 in FIG. 9 are an accelerating electrode and a focusing electrode, respectively, which are arranged between the photocathode 2 and the deflection plates 3 in the order written.

The operation of the streak tube shown in FIG. 9 requires repeated sweeping of the travelling photoelectrons by means of the deflection plates 3, with each main sweep being followed by a retrace. If light is incident on the photocathode 2 during the retracing, it will appear as a pseudo signal on the phosphor screen 4 and the resulting overlap with a true signal obtained during the main sweep introduces difficulty in achieving correct measurements. In order to prevent the generation of such pseudo signals, the photoelectrons that are emitted during retracing have been gated by various methods.

One of such conventional methods is illustrated in FIGS. 10A and 10B for the streak tube shown in FIG. 9. According to this method, when a sweep voltage of FIG. 10A is applied, the occurrence of pseudo signals is prevented by reducing a MCP voltage during the retrace interval as shown in FIG. 10B.

Another method suppresses the emission of photoelectrons by raising the voltage of the photocathode 2 to become equal to that of the accelerating electrode 6.

In a sampling streak camera, shifting electrodes are positioned at a right angle to the main deflection plates and, during retracing, a voltage is applied to said shifting electrodes to bring the travelling photoelectrons out of the field of view.

In a synchroscan streak camera in which a sine wave is applied to the main deflection plates, the photoelectrons emitted during retracing are brought out of the field of view by performing elliptical sweep in which a phase-shifted sine wave is applied to shifting electrodes positioned at a right angle to the main deflection plates.

In order to improve the temporal resolution of streak tubes, it has become popular to use the travelling-wave deflection plates which allow the deflection voltage to propagate at an equal speed to the travelling electrons in the electron tube. The travelling-wave deflection plates used in such streak tubes are designed to have a low characteristic impedance and are driven with a high-voltage, high-speed and low-output-impedance drive circuit. If sweep is done by the combination of such deflection plates and drive circuit, the low impedance of the system will cause retracing to start only a few nanoseconds after each main sweep. Further, jitter is likely to occur between the main sweep timing and the timing of gating in retracing.

Because of these problems, it is difficult to achieve correctly timed retracing with the conventional circuitry. Furthermore, pseudo signals will appear during retracing unless the rise time of gating is shortened to a few nanoseconds, but this has involved considerable difficulty.

SUMMARY OF THE INVENTION

The present invention has been accomplished under these circumstances of the prior art and its object is to provide a method of gating an electron tube that not only facilitates the performance of timed retracing but also insures complete gating of pseudo signals during retracing. Another object of the present invention is to provide an electron tube that is operated by this method.

The first object of the present invention can be attained by a method of gating pseudo signals during retracing in an electron tube in which electrons emitted from a photocathode in response to incident light are swept by means of main deflection plates supplied with a drive voltage from a drive voltage generator circuit, which method is characterized in that gate means for gating the electrons in the electron tube so that they do not appear as an output is supplied with the same drive voltage with a delay from the end of a main sweep by the main deflection plates.

The second object of the present invention can be attained by an electron tube which has a photocathode for emitting electrons in response to incident light, an electron tube drive voltage generator circuit, and main deflection plates for sweeping the emitted electrons by the drive voltage from said drive voltage generator circuit, which electron tube is characterized by further including gate means that contains a gate element for gating the electrons in the electron tube using said drive voltage so that they do not appear as an output, and delay means for applying said drive voltage to the gate means with a delay from the end of a main sweep by said main deflection plates.

In one embodiment of the present invention, travelling-wave deflection plates are used as said main deflection plates.

In another embodiment, shifting deflection plates that perform sweeping in a direction generally perpendicular to the main sweeping direction are used as said gate element.

In still another embodiment, a microchannel plate to which the electrons deflected by said main deflection plates are directed is used as said gate element.

In a further embodiment, the photocathode is used as said gate element.

In yet another embodiment, the gate element is supplied with a divided voltage in terminator means for establishing electrical termination of said drive voltage.

In accordance with the present invention, the gate element which gates the electrons in the electron tube in such a way that they do not appear as an output is designed as either the shifting deflection plates, microchannel plate or photocathode, and the drive voltage from the electron tube drive voltage generator circuit which is applied to the main deflection plates is also applied to this gate element at a time slightly delayed from its application to the main deflection plates. Hence, precisely timed gating can be performed to prevent pseudo signals from appearing on the phosphor screen during retracing. Further, the electron tube drive voltage generator circuit which applies the drive voltage to the main deflection plates also serves as a gating circuit, so there is no need to provide an additional drive circuit and the overall circuit configuration can be simplified. In addition, no jitter will occur between the main sweep timing and the timing of gating during retrace.

DETAILED DESCRIPTION OF THE PREFERRED EMBODIMENTS

Embodiments of the present invention are described below with reference to FIGS. 1–8.

Figure 1:
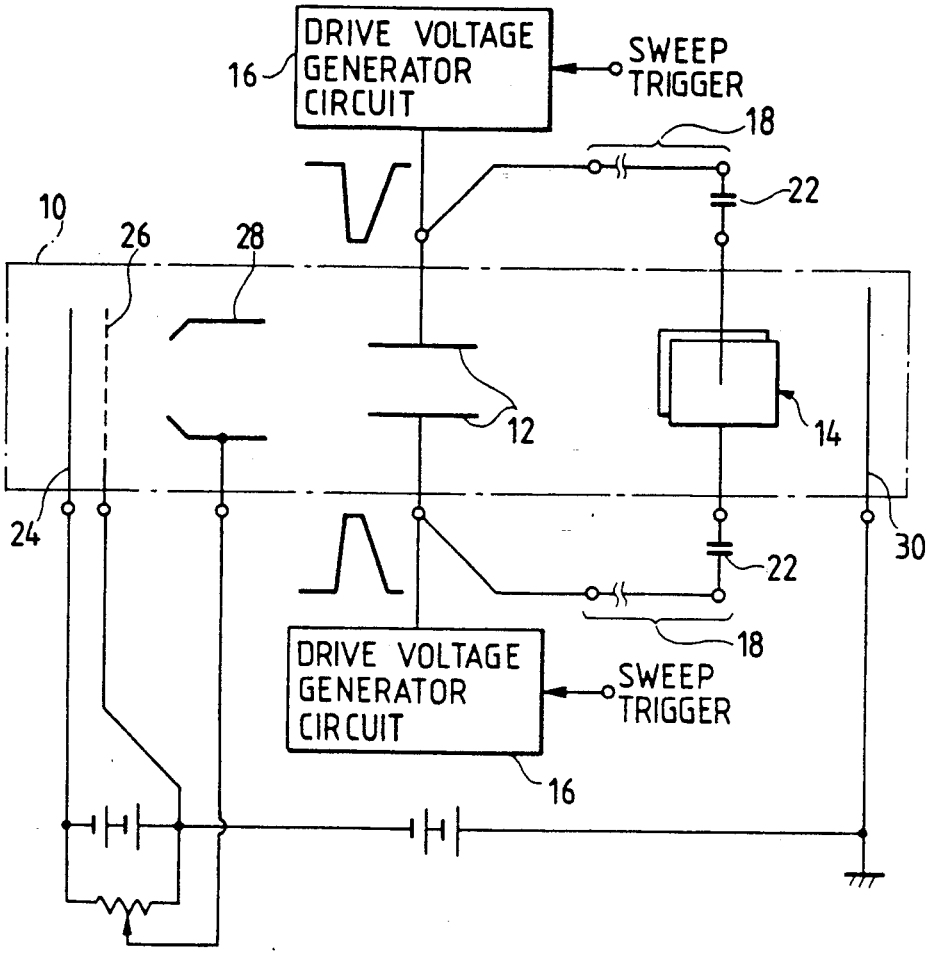
FIG. 1 is a block diagram showing a first embodiment of the present invention in which a streak tube is used as an example of an electron tube.
Figure 2:
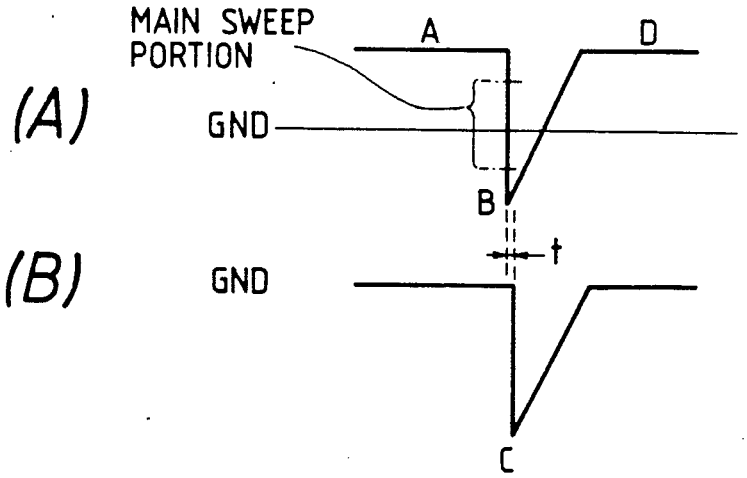
FIG. 2 is a diagram showing waveforms of a main sweep voltage and shifting voltage applied in the first embodiment
Figure 3:
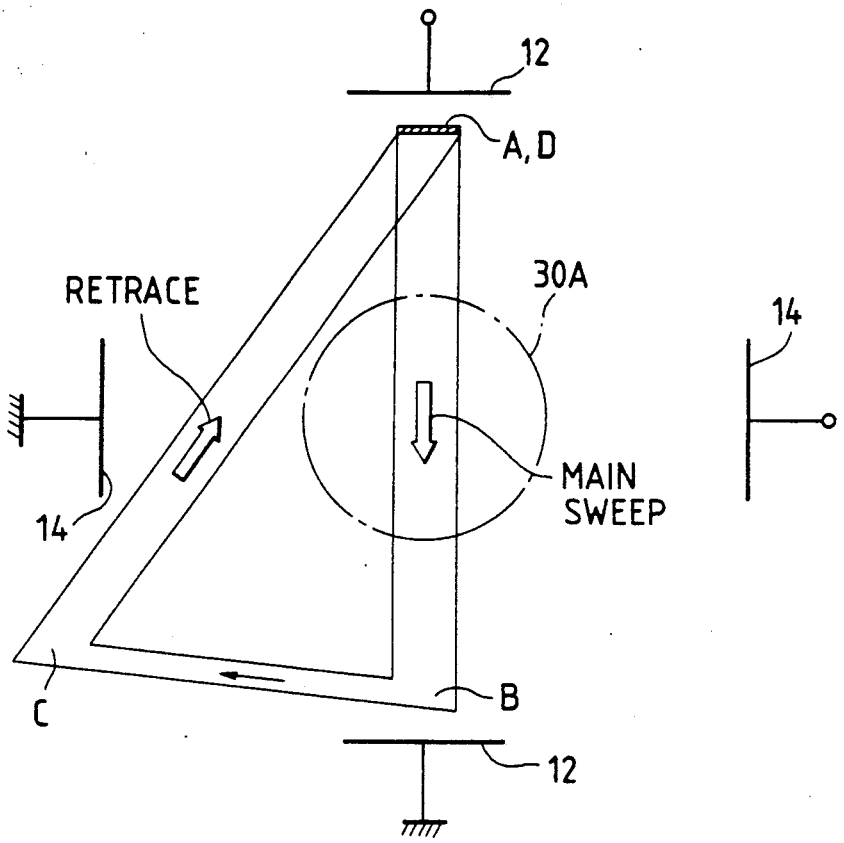
FIG. 3 is a front view showing the trajectory of a photoelectron image with respect to the main deflection plates and shifting deflection plates as observed in the first embodiment.

FIG. 1 is a block diagram showing a first embodiment of the present invention in which a streak tube is used as an example of an electron tube. The streak tube generally indicated by numeral 10 includes main deflection plates 12 and shifting deflection plates 14 that are positioned at a right angle to the main deflection plates 12. The drive voltage for sweeping which is applied from a drive voltage generator circuit 16 to the main deflection plates 12 is also supplied to the shifting deflection plates 14 via a delay line 18 and a capacitor 22. Shown by numerals 24, 26, 28 and 30 in FIG. 1 are a photocathode, an accelerating electrode, a focusing electrode and a phosphor screen, respectively.

The streak tube 10 shown in FIG. 1 operates as follows. First, in response to a sweep trigger, a drive voltage with a very short rise time is supplied from the drive voltage generator circuit 16 to the main deflection plates 12 to perform main sweep. The same drive voltage is also applied to the shifting deflection plates 14 via the delay line 18. When the drive voltage is applied to the shifting deflection plates 14, photoelectrons that have been emitted from the photocathode 24 and accelerated and focused by the electrodes 26 and 28, respectively, are shifted by means of the shifting deflection plates 14 in a direction perpendicular to the direction of sweeping by the main deflection plates 12. The main sweep voltage has a waveform shown in part (A) of FIG. 2, and the photoelectrons swept with this voltage move along the path defined by A and B in FIG. 3.

The delay line 18 is preliminarily adjusted for the propagation time of the drive voltage (its delay time is adjusted) in such a way that the shifting deflection is started immediately after the sweeping by the main deflection plates 12. Thus, as soon as the main sweeping by the main deflection plates 12 is completed, the rapidly rising drive voltage is applied to the shifting deflection plates 14, so that at the start of the retracing, the direction of deflection is shifted with a delay time t as shown in part (B) of FIG. 2, whereby the photoelectron image will move along the path defined by B and C in FIG. 3. Hence, the photoelectrons being retraced are brought out of the effective output surface (phosphor screen) of the streak tube which is indicated by 30A in FIG. 3, and no pseudo signal will be generated.

Figure 4:
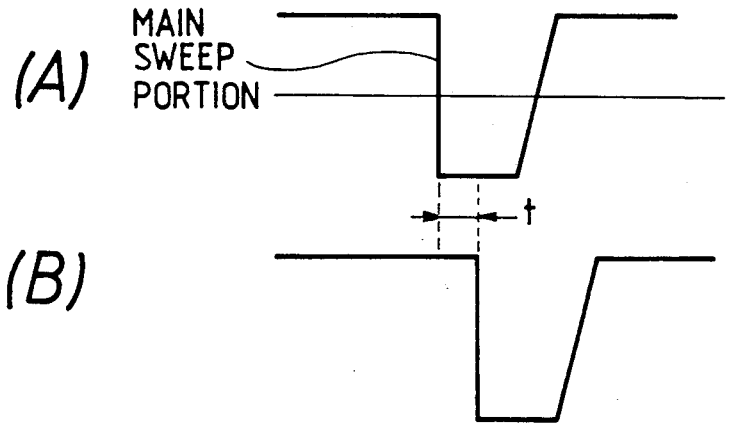
FIG. 4 is a diagram showing another example of waveforms of a main sweep voltage and shifting voltage applied in the present invention.

The above discussion assumes that the drive voltage from the drive voltage generator circuit 16 has a triangular waveform, but it may have a trapezoidal waveform, in which case the delay time, t, or the propagation time of the drive voltage through the delay line 18 is increased as shown in FIG. 4.

Figure 5:
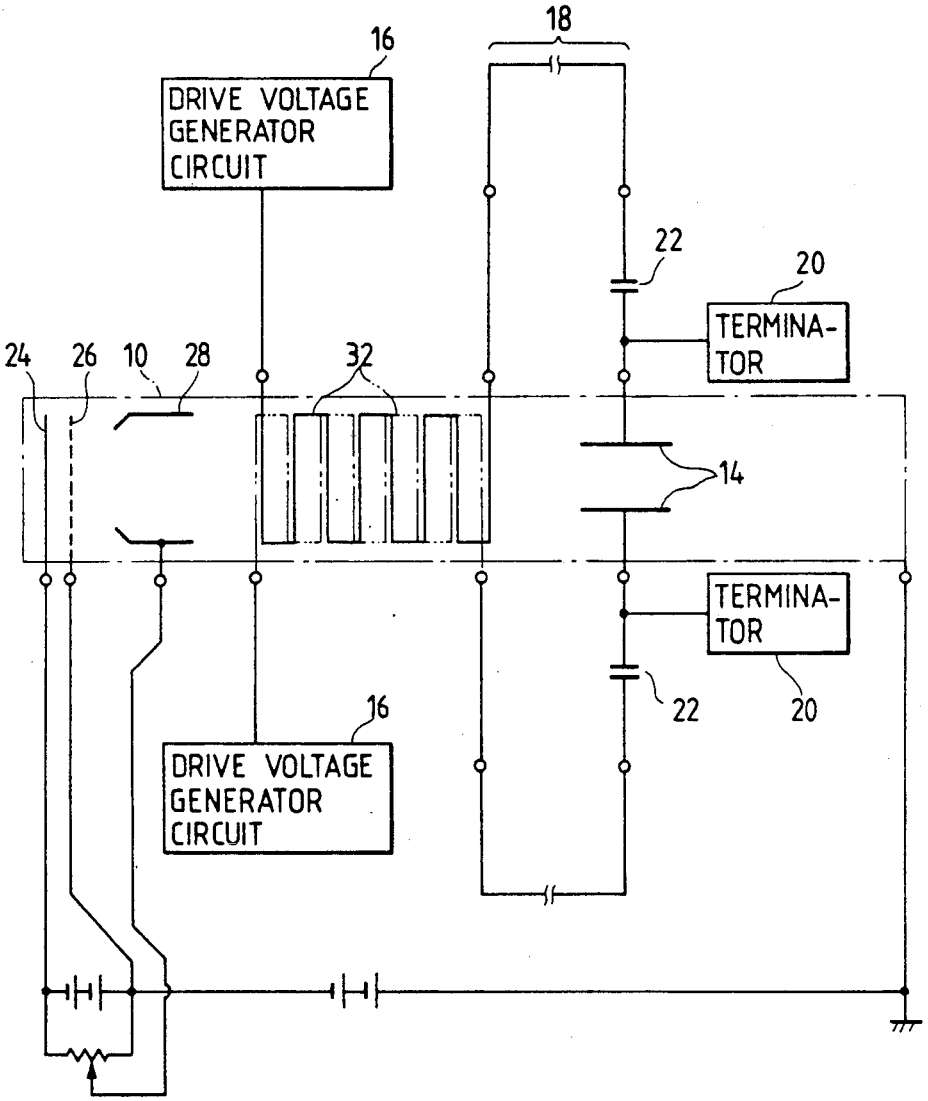
FIGS. 5–8 are block diagrams showing second to fifth embodiments of the present invention.

FIG. 5 shows a second embodiment of the present invention, in which travelling-wave deflection plates 32 are used as the main deflection plates. In this second embodiment, the shifting deflection plates 14 are connected to the terminating ends of the travelling-wave deflection plates 32 through the delay line 18 and the capacitor 22. Terminators 20 are connected to the respective shifting deflection plates. The other parts of the circuit shown in FIG. 5 are identical to the first embodiment shown in FIG. 1, so like parts are identified by like numerals and will not be described in detail. The travelling-wave deflection plates 32 have a characteristic impedance, so the terminators 20 are typically set to match this characteristic impedance.

The travelling-wave deflection plates 32 used as the main deflection plates in the second embodiment are capable of high-speed main sweeping. Since the drive voltage itself for the main sweeping is applied to the shifting deflection plates 14, the shifting voltage for the shifting deflection plates 14 has a sufficiently rapid rise time and optimum timing to avoid any delay from the end point of the main sweeping. As a result, no pseudo signal will be generated on the phosphor screen 30 during the retracing.

Figure 6:
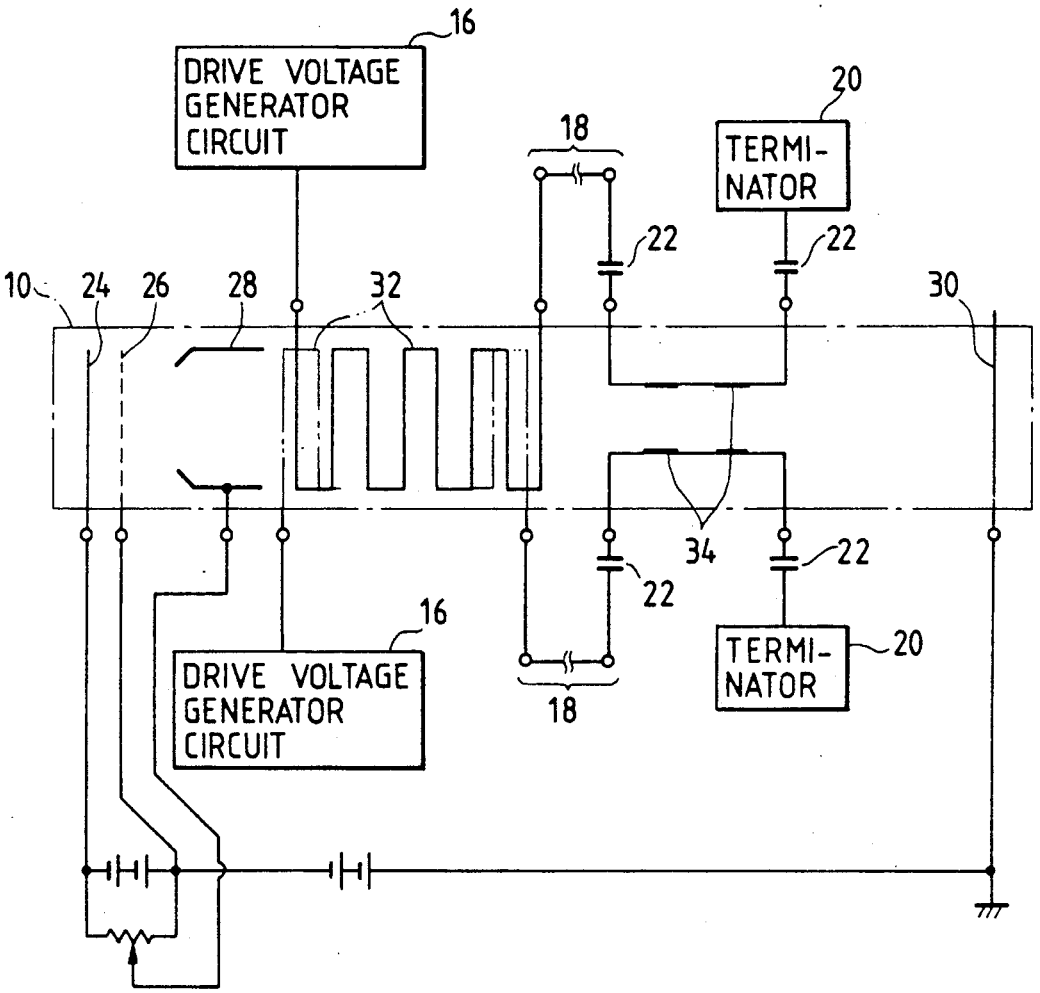

FIG. 6 shows a third embodiment of the present invention which is identical to the second embodiment described above except that travelling-wave deflection plates 34 are also used as the shifting deflection plates. The other parts which are identical to the second embodiment will not be described in detail. The travelling-wave deflection plates 34 used as the shifting deflection plates in this third embodiment are capable of performing rapid shifting deflection, so compared to the second embodiment, the third embodiment will insure even more reliable gating of the photoelectrons being retraced.

Figure 7:
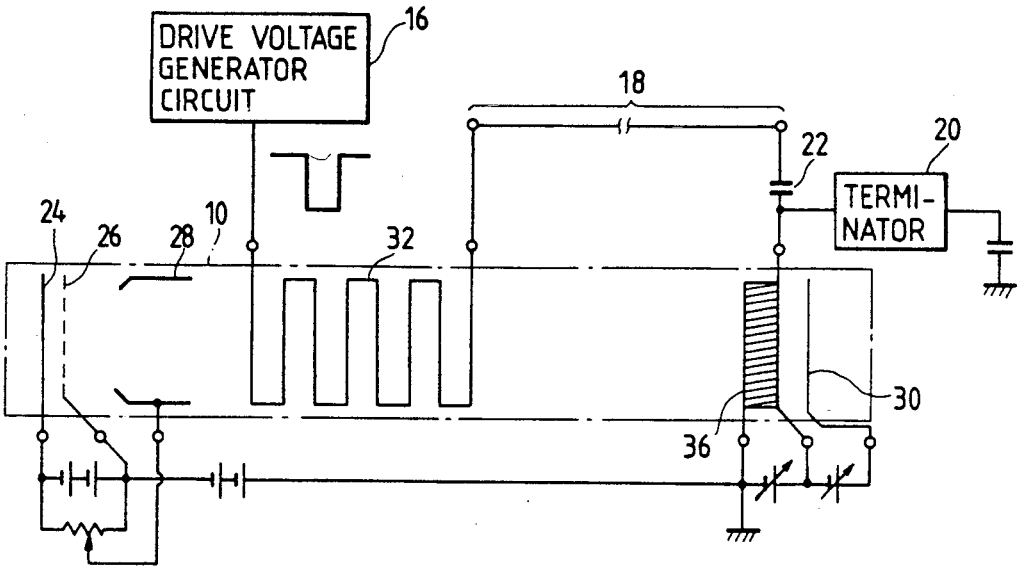

FIG. 7 shows a fourth embodiment of the present invention, in which a MCP 36 is used as the gate element. The system according to this fourth embodiment is so constructed that the drive voltage from the drive voltage generator circuit 16 is applied to the MCP 36 via the travelling-wave deflection plates 32, the delay line 18 and the capacitor 22. In the steady state, the MCP 36 is supplied with a constant voltage between its input and output sides to effect the electron multiplication. While the drive voltage is applied to the output side of this MCP 36 through the delay line 18, the output-side voltage is kept equal to the input-side voltage to prevent the MCP 36 from being actuated. For example, in the steady state a DC voltage of 1 kV is applied to the output side of the MCP 36, and in the gating period of, e.g., 10 nsec a drive voltage of −1 kV is applied to the output side, whereby in such a period the electron multiplication by the MCP 36 is prohibited. The other parts of the fourth embodiment are identical to the second and third embodiments, so like parts are identified by like numerals and will not be described in detail.

In accordance with the fourth embodiment, when the drive voltage from the drive voltage generator circuit 16 is applied to the travelling-wave deflection plates 32 and the same drive voltage is applied to the MCP 36 via the delay line 18 after a predetermined propagation time (delay time), no actuating voltage will be applied to the MCP 36, whereby it remains disabled to perform the function of multiplying photoelectrons as long as the drive voltage is applied to it. This event is timed to the start of retracing which follows the end of the main sweeping with the travelling-wave deflection plates 32, so none of the photoelectrons being retraced will be multiplied by the MCP 36 to arrive at the phosphor screen 32. In other words, pseudo signals during retracing is properly gated.

Figure 8:
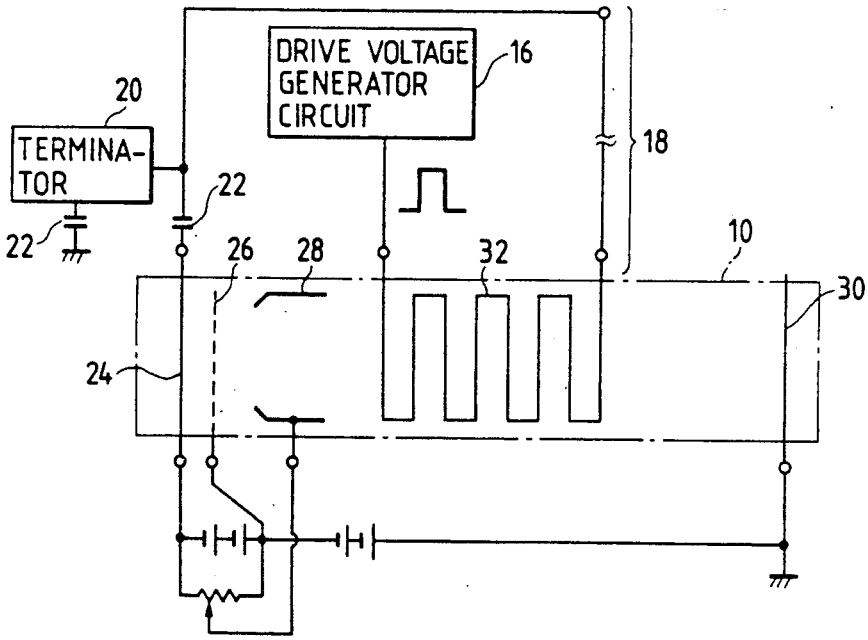
Figure 9:
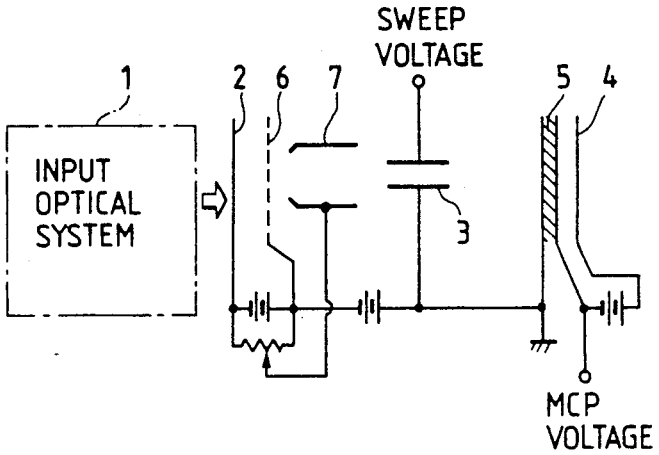
FIG. 9 PRIOR ART
FIG. 9 is a circuit diagram of a prior art streak tube.
Figure 10A:
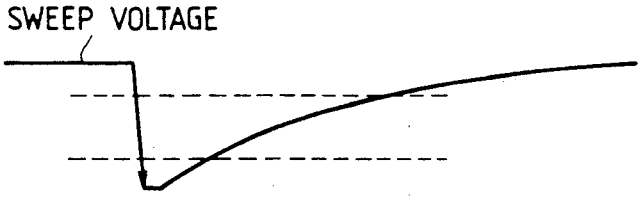
FIG. 10A PRIOR ART
FIGS. 10A and 10B are diagrams showing the relationship between a sweep voltage and MCP voltage applied to the prior art streak tube.
Figure 10B:
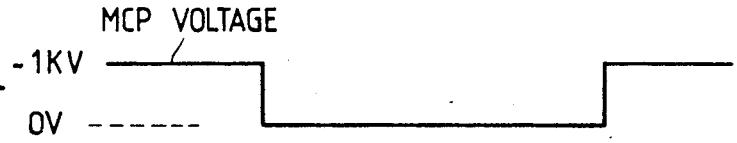
FIG. 10B PRIOR ART

FIG. 8 shows a fifth embodiment of the present invention, in which the photocathode 24 is used as the gate element, namely, the output from the travelling-wave deflection plates 32 is applied to the photocathode 24 via the delay line 18. In this case, the constant voltage to be applied to the photocathode 24 is set so as to be lower than the potential of the accelerating electrode 26. According to this fifth embodiment, when the drive voltage for the travelling-wave deflection plates 32 is applied to the photocathode 24 via the delay line 18 after the end of the main sweeping with said deflection plates 32, the potential of the photocathode 24 will become larger than that of the accelerating electrode 26, whereby the emission of photoelectrons from the photocathode 24 is impeded as long as said drive voltage is applied to the photocathode 24. In other words, no photoelectrons will be emitted from the photocathode 24 when retracing starts after the end of the main sweeping. Hence, during the retracing no photoelectrons will be generated to arrive at the phosphor screen 30 to produce an undesired streak image (pseudo signal).

It is noted here that if the voltage across the terminator 20 is too large to be applied to the gate element as the drive voltage, a divided voltage in the terminator 20 may be supplied to the gate element.

Having the features described above, the gating method of the present invention is capable of preventing the generation of pseudo signals during retracing that follows main sweeping. A particular advantage of this method is that it definitely prevents the generation of pseudo signals even if travelling-wave deflection plates are used to perform high-speed main sweeping. Further, a separate circuit for driving the gate element is unnecessary since the drive voltage itself applied from the drive voltage generator circuit for achieving the main sweeping can be used to drive the gate element. In addition, the main deflection plates are connected to the gate element via passive elements such as a delay line and a capacitor, so a correct signal can always be obtained without jitter. The present invention offers the added advantage of being adapted to meet the low output impedance of the drive circuit for deflection plates, which design has been employed to match recent versions of streak tubes or the like having higher temporal resolution.

What is claimed is:

1. An electron tube comprising:

a photocathode for emitting electrons in response to incident light;

drive voltage generating means for generating a drive voltage;

main deflection plates provided with the drive voltage, for sweeping the electrons in a main sweeping direction;

gate means provided with the drive voltage, for gating the electrons so that the electron tube does not produce, in a gating period, an output signal corresponding to the electrons; and delay means for providing the drive voltage to the gate means with a predetermined delay from an end of a main sweep by the main deflection plates.

2. An electron tube according to claim 1, wherein the delay means transmits the drive voltage from the main deflection plates to the gate means with the predetermined delay.

3. An electron tube according to claim 1, wherein the main deflection plates are travelling-wave deflection plates.

4. An electron tube according to claim 3, wherein the shifting deflection plates are travelling-wave deflection plates.

5. An electron tube according to claim 1, wherein the gate means comprises shifting deflection plates for sweeping the electrons in a direction generally perpendicular to the main sweeping direction.

6. An electron tube according to claim 1, wherein the gate means comprises a microchannel plate disposed in the rear of the main deflection plates, for multiplying the electrons.

7. An electron tube according to claim 1, wherein said delay means comprises a series connection of a delay line and a capacitor.

8. A gating method of an electron tube, comprising the steps of:

emitting electrons by a photocathode in response to incident light;

generating a drive voltage;

sweeping the electrons in a main sweeping direction by main deflection plates which are provided with the drive voltage;

providing the drive voltage to gate means with a predetermined delay from an end of a main sweep by the main deflection plates; and gating the electrons by the gate means so that the electron tube does not produce, in a gating period, an output signal corresponding to the electrons.

9. The gating method according to claim 8, wherein the drive voltage is transmitted from the main deflection plates to the delay means with the predetermined delay.

10. The gating method according to claim 8, wherein the main deflection plates are travelling-wave deflection plates.

11. An electron tube according to claim 1 wherein the drive voltage waveform is triangular.

12. An electron tube according to claim 1 wherein the drive voltage waveform is trapezoidal.

13. An electron tube comprising:

a photocathode for emitting electrons in response to incident light;

drive voltage generating means for generating a drive voltage;

main travelling-wave deflection plates provided with the drive voltage, for sweeping the electrons in a main sweeping direction;

terminating means for terminating the drive voltage from the main travelling-wave deflection plates;

gate means for gating the electrons so that the electron tube does not produce, in a gating period, an output signal corresponding to the electrons;

delay means for providing the drive voltage to the gate means and the terminating means with a predetermined delay from an end of a main sweep by the main travelling-wave deflection plates, wherein the gate means is provided with a divided drive voltage from the terminating means.

14. An electron tube according to claim 13, wherein the delay means transmits the drive voltage from the main travelling-wave deflection plates to the gate means and the terminating means with the predetermined delay.

15. An electron tube comprising:

a photocathode for emitting electrons in response to incident light;

drive voltage generating means for generating a drive voltage;

main deflection plates provided with the drive voltage, for sweeping the electrons in a main sweeping direction;

delay means for providing the drive voltage to the photocathode with a predetermined delay from an end of a main sweep by the main deflection plates, whereby the electrons are gated so that the electron tube does not produce, in a gating period, an output signal corresponding to the electrons.

16. An electron tube according to claim 15, wherein the main deflection plates are travelling-wave deflection plates.

* * * * *